US007861824B2

(12) United States Patent
Prommersberger

(10) Patent No.: US 7,861,824 B2
(45) Date of Patent: Jan. 4, 2011

(54) SOUND ABSORBER FOR AN EXHAUST SYSTEM

(75) Inventor: Holger Prommersberger, Hemmingen (DE)

(73) Assignee: J. Eberspacher GmbH & Co. KG, Esslingen (DE)

( * ) Notice: Subject to any disclaimer, the term of this patent is extended or adjusted under 35 U.S.C. 154(b) by 1165 days.

(21) Appl. No.: 11/181,313

(22) Filed: Jul. 14, 2005

(65) Prior Publication Data

US 2006/0011410 A1 Jan. 19, 2006

(30) Foreign Application Priority Data

Jul. 14, 2004 (DE) ..... 10 2004 034 206

(51) Int. Cl.

| | |
|---|---|
| ***F01N 13/08*** | (2010.01) |
| ***F01N 1/02*** | (2010.01) |
| *F01N 13/00* | (2010.01) |
| *F01N 1/04* | (2010.01) |
| *F01N 1/24* | (2010.01) |

(52) U.S. Cl. ..... 181/238; 181/248

(58) Field of Classification Search ..... 181/238, 181/239, 241, 243, 216, 240, 252, 256, 247, 181/248

See application file for complete search history.

(56) References Cited

U.S. PATENT DOCUMENTS

| | | | | |
|---|---|---|---|---|
| 1,468,241 | A * | 9/1923 | Larsen | 181/227 |
| 3,420,052 | A | 1/1969 | Miller | |
| 3,605,940 | A * | 9/1971 | Christensen | 181/228 |
| 4,206,178 | A | 6/1980 | Oya et al. | |
| 4,475,622 | A * | 10/1984 | Tsunoda et al. | 181/227 |
| 4,621,494 | A | 11/1986 | Fujita | |
| 4,763,471 | A * | 8/1988 | Keller | 181/227 |
| 4,809,800 | A * | 3/1989 | Suzuki | 180/219 |
| 4,821,840 | A * | 4/1989 | Harwood et al. | 181/282 |
| 5,138,834 | A * | 8/1992 | Maund et al. | 60/276 |
| 5,148,597 | A * | 9/1992 | Weeks | 29/890.08 |
| 5,588,888 | A * | 12/1996 | Magharious | 440/89 R |
| 5,766,559 | A * | 6/1998 | Blanchet et al. | 422/171 |
| 5,775,100 | A * | 7/1998 | Sloss et al. | 60/299 |
| 5,996,339 | A * | 12/1999 | Gottberg et al. | 60/299 |
| 6,349,541 | B1 * | 2/2002 | Gruden et al. | 60/312 |
| 6,455,009 | B1 * | 9/2002 | Kato et al. | 422/110 |
| 6,457,551 | B1 * | 10/2002 | Chang | 181/243 |
| 6,470,998 | B1 * | 10/2002 | White | 181/243 |

(Continued)

FOREIGN PATENT DOCUMENTS

| | | |
|---|---|---|
| DE | 1924298 | 7/1970 |

(Continued)

OTHER PUBLICATIONS

German Search Report dated Apr. 22, 2005.

*Primary Examiner*—Edgardo San Martin
(74) *Attorney, Agent, or Firm*—Howard IP Law Group, PC

(57) ABSTRACT

The invention relates to a sound absorber for an exhaust system having a Y-shaped feed piece arranged upstream from the sound absorber, combining two exhaust gas-carrying lines to form a single line entering into the sound absorber whereby the Y-shaped feed piece and the sound absorber are assembled from a common bottom shell and a common top shell. The invention also relates to an exhaust system equipped with the sound absorber.

20 Claims, 2 Drawing Sheets

U.S. PATENT DOCUMENTS

| | | | | |
|---|---|---|---|---|
| 6,520,285 | B2 * | 2/2003 | Tobias | 181/241 |
| 6,715,581 | B2 * | 4/2004 | Dooley | 181/228 |
| 6,889,499 | B2 * | 5/2005 | Bassani | 60/312 |
| 2003/0136607 | A1 * | 7/2003 | Kawamata et al. | 181/231 |
| 2004/0069562 | A1 * | 4/2004 | Kondo et al. | 181/227 |
| 2004/0213707 | A1 * | 10/2004 | Prommersberger et al. | 422/180 |
| 2006/0201742 | A1 * | 9/2006 | Terashima et al. | 181/227 |

FOREIGN PATENT DOCUMENTS

| | | | | |
|---|---|---|---|---|
| DE | 3415064 | A1 | | 10/1985 |
| DE | 19962379 | A1 | | 6/2001 |
| EP | 77148 | A1 | * | 4/1983 |
| JP | 58002412 | A | * | 1/1983 |
| JP | 58204562 | | | 10/1983 |
| JP | 60198320 | A | * | 10/1985 |
| JP | 04314911 | A | * | 11/1992 |

* cited by examiner

SOUND ABSORBER FOR AN EXHAUST SYSTEM

FIELD OF INVENTION

The present invention relates to a sound absorber for an exhaust system and an exhaust system equipped with such a sound absorber.

BACKGROUND OF INVENTION

It is generally known that sound absorbers may be used in exhaust systems, in particular in the exhaust systems of motor vehicles, to minimize sound emission during operation of the system. Since sound absorbers are needed in mass-produced quantities, it would be desirable to make the production thereof as inexpensive as possible while still obtaining a high quality.

The present invention relates to the problem of providing an improved embodiment for a sound absorber of the type mentioned above, so that the cost of manufacturing in particular can be reduced while at the same time the quality of an exhaust system equipped with the sound absorber can be enhanced.

This problem is solved according to this invention by the objects of the independent claims. Advantageous embodiments are the object of the dependent claims.

SUMMARY OF THE INVENTION

The present invention is based on the general idea of assembling a sound absorber and a feed piece arranged upstream from the sound absorber and consisting of a common bottom shell and a common top shell. The feed piece is designed in a Y shape and combines two exhaust-carrying lines to form a single line entering the sound absorber. The cost of manufacturing can be reduced due to the use of the common bottom shell and/or top shell because the connection to be established between the sound absorber and the feed piece is now eliminated. In doing so, the common top shell and/or bottom shell is shaped from a single sheet of metal, e.g., by deep drawing, so that the manufacturing process for the respective bottom shells and top shells of the feed piece and the sound absorber, which had previously been separated, can now be combined.

On the whole, this greatly simplifies the manufacturing process because only the common top shell and bottom shell need be joined together, e.g., welded together and no additional connection, e.g., a screw connection or welded connection, is necessary between the sound absorber and the feed piece. A joining operation can be omitted using the inventive approach, and, as the sound absorbers are needed in large numbers, this makes it possible to achieve considerable cost advantages. In addition, the quality of the sound absorber can be enhanced because manufacturing mistakes can be avoided and/or reduced due to the elimination of the additional connection between the sound absorber and the feed piece. Furthermore, the pressure drop and acoustic excitation can be reduced, both of which phenomena occur at such a connection site.

According to one embodiment of the inventive approach, a probe for measuring parameters relevant to the exhaust gas is provided in an area of an intersection point of the two lines with the feed piece. This mounting point offers the advantage that the probe is exposed to a preferably uniform oncoming flow of exhaust gases from the two lines, therefore permitting an accurate determination of the aforementioned parameters. The precise determination of parameters relevant to the exhaust gas permits a targeted adjustment of the engine control and thus a high yield in terms of performance with especially low pollution emissions by the exhaust system and/or the engine.

The sound absorber preferably has an outlet line designed as a separate part. This outlet line is displaceably mounted by at least one sliding seat in the sound absorber. The displaceable mounting offers the advantage that thermally induced expansion does not produce stresses which could damage the exhaust system and/or the sound absorber. Due to the sliding seat, the displacement of the outlet line in relation to the sound absorber in the longitudinal direction of the outlet line is ensured, so that temperature fluctuations which usually occur during operation of an exhaust system can easily be compensated.

In another preferred embodiment, an absorber material is arranged between the outlet line and the top shell and bottom shell of the sound absorber. The absorber material absorbs sound and thus attenuates the sound emission by the exhaust system, thereby ensuring operation of a motor vehicle equipped with said sound absorber with reduced emissions. In the area in which the outlet line is surrounded by absorber material, the outlet line is designed to be gas-permeable at least in some areas, e.g., with perforations, so that passage of sound through a wall of the outlet line is facilitated.

The outlet line is expediently at least partially sheathed by a gas-permeable blowout protection within the sound absorber. In the event of a vacuum in the sound absorber, for example, such a blowout protection prevents absorber material from passing through the gas-permeable wall of the outlet line and being emitted into the environment with the exhaust. In general, the blowout protection may have a mesh-like cloth of steel wool so finely woven that passage of absorber material is prevented. The blowout protection, which according to a particularly preferred embodiment may also have a chromium steel sleeve, thus ensures that the absorber material will remain between the blowout protection and the top shell and/or bottom shell of the sound absorber and thus ensures the functioning of the sound absorber. Glass wool, for example, may be provided as the absorber material.

In addition, in yet another embodiment, the feed piece may have at least one fluid guidance contour which produces a uniform mixing of exhaust gases flowing out of the two lines and a targeted oncoming flow toward the probe. Such a fluid guidance contour may have baffles, for example, which preferably homogeneously mix the exhaust gases arriving from the two lines and direct them to the probe, e.g., an NOX probe, located in the area of the point of intersection of the two lines. This permits especially accurate measured values which are necessary for accurate engine control.

Other important features and advantages of this invention are derived from the claims, the drawings and the respective description of the figures on the basis of the drawings.

It is self-evident that the aforementioned features as well as those yet to be explained below may be used not only in the particular combination given but also in other combinations or even alone without going beyond the scope of the present invention.

A preferred exemplary embodiment of this invention is depicted in the drawings and is explained in greater detail in the following description.

BRIEF DESCRIPTION OF THE FIGURES

The figures show the following schematically.

DETAILED DESCRIPTION OF THE PREFERRED EMBODIMENTS

Figure 1:
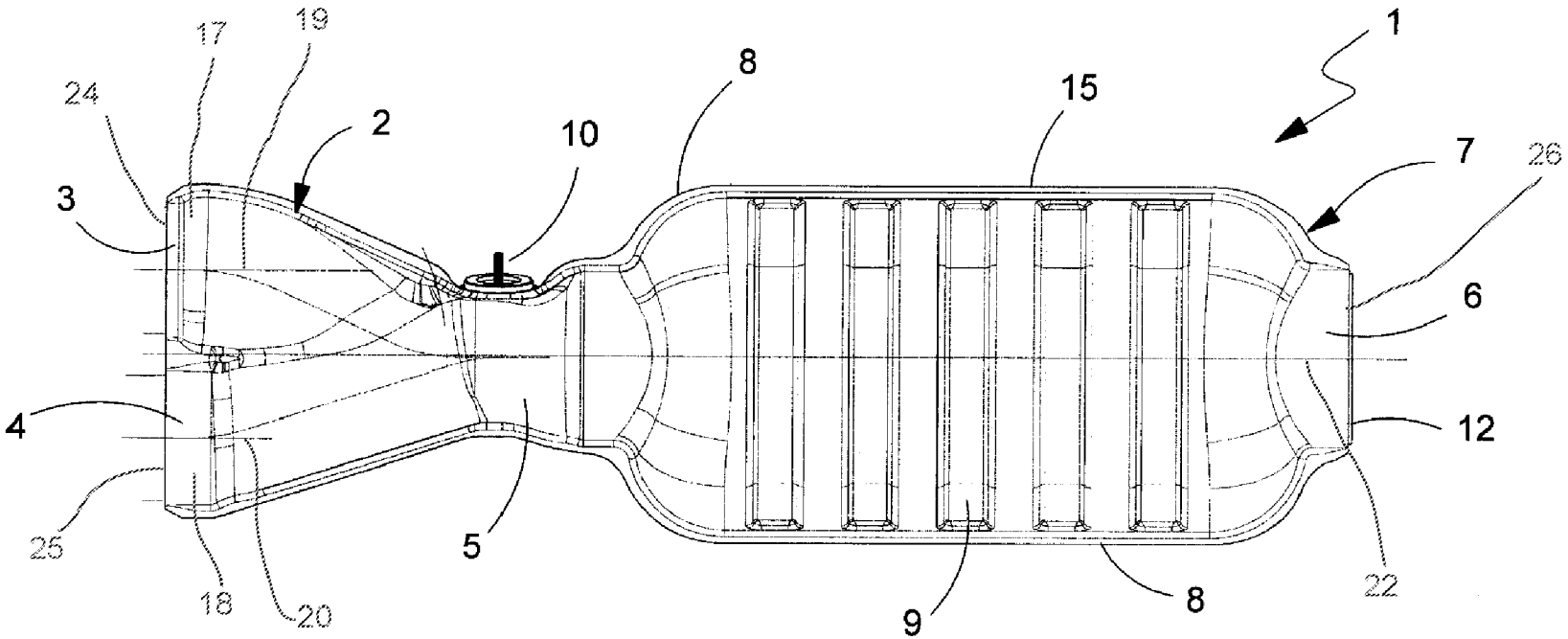
FIG. 1 a perspective top view of an inventive sound absorber

According to FIG. 1, an inventive sound absorber 1 has a Y-shaped feed piece 2 upstream from the sound absorber 1 for an exhaust system (not shown otherwise), e.g., an exhaust system for an internal combustion engine in a motor vehicle. This feed piece combines two exhaust gas-carrying lines 3, 4 to form a single line 5 entering into the sound absorber 1. The two lines 3, 4 may be assigned to two flows which carry the combustion exhaust gases of the internal combustion engine in two separate exhaust systems up to the common sound absorber 1. The transition between the two exhaust lines 3, 4 into the combined exhaust line 5 which follows them downstream is accomplished in a manner that is advantageous from the standpoint of fluid guidance, i.e., without gradations. Upstream from the feed piece 2, at least one de-NOX catalyst (not shown) may be provided there, said catalyst being designed to reduce nitrogen oxides in exhaust gases.

Figure 2:
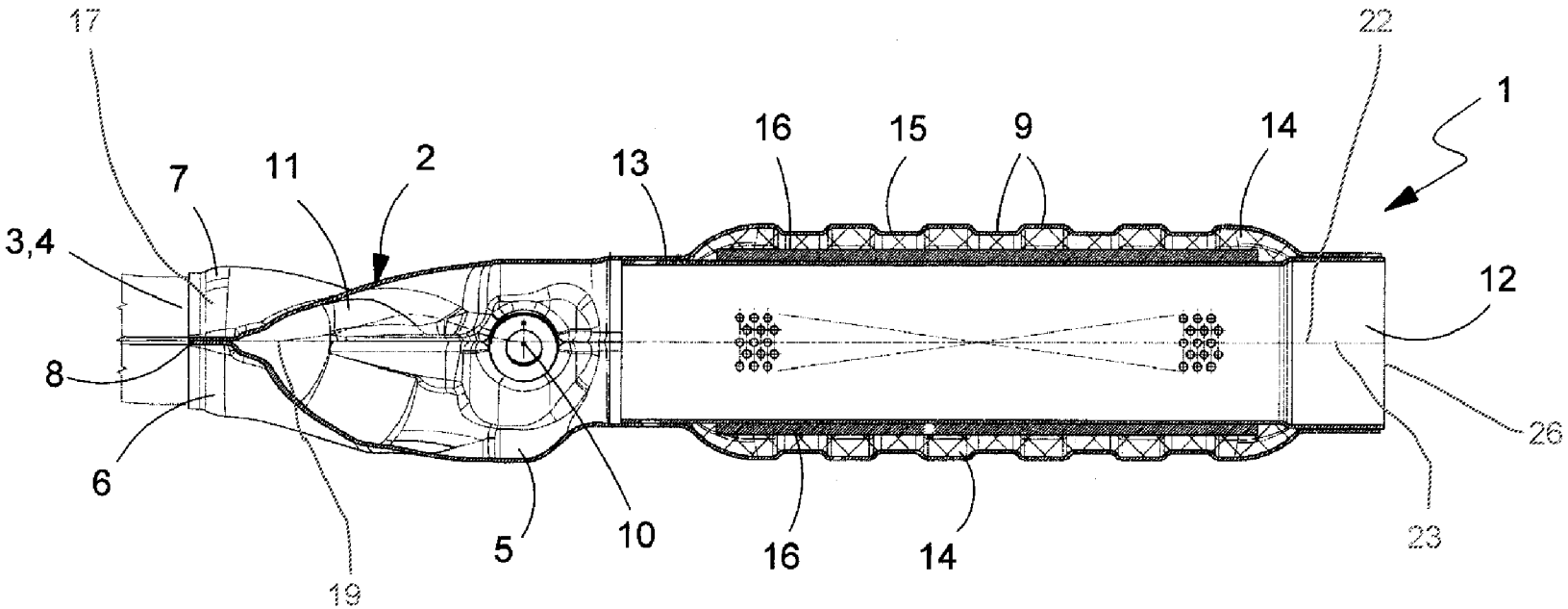
FIG. 2 a longitudinal section through the inventive sound absorber.

Both the Y-shaped feed piece 2 as well as the sound absorber 1 are assembled according to this invention from a common bottom shell 6 and a common top shell 7 (see FIG. 2). Both the bottom shell 6 and the top shell 7 are preferably designed as sheet metal parts, in particular as drawn and/or pressed sheet metal parts. Due to the one-piece design of each shell part 6, 7, a tight connection between the feed piece 2 and the sound absorber 1 is achieved on the one hand, while on the other hand, assembly of the sound absorber 1 on the feed piece 2 subsequently is unnecessary. In particular, the subsequent joining of parts, e.g., by screwing or welding, requires an additional operation and thus increases production costs. The sound absorber 1 may merely be welded along a longitudinal seam 8 during assembly so that problems with regard to intersecting welds with the resulting thermal forced stresses can be avoided. Furthermore, the inventive approach offers the advantage of reducing the variety of parts due to the common top shell 7 and bottom shell 6 of the sound absorber 1 and the intermediate piece 2, thereby saving on storage and logistics costs.

The sound absorber 1, e.g., a central sound absorber, may be situated on the floor of a motor vehicle (not shown) and has a profiled surface with multiple ribs 9 for cooling. These ribs serve to enlarge the surface area and thus improve the dissipation of heat into the environment.

In the area where the two exhaust lines 3, 4 intersect probe 10 for measuring parameters relevant to the exhaust gas is mounted on the feed piece 2. The probe 10 here may be designed as an NOX probe, for example, and may detect the nitrogen oxide content in the exhaust gas. To obtain the most accurate possible measured values and thus permit the most accurate possible engine control, the feed piece 2 may have at least one fluid guidance contour 11 (see FIG. 2) which produces a uniform mixing of exhaust gases flowing out of the two lines 3, 4 and produces a targeted oncoming flow of the probe 10. The flow guidance contour 11 may have fluid guidance faces and/or baffles (not shown in greater detail here), for example, preferably being shaped by pressing and/or deep drawing of the two shells 6, 7.

According to FIG. 2, the sound absorber 1 has an outlet line 12 which may be designed as a separate part and may be situated downstream from the sound absorber 1, carrying the gases to an opening of the exhaust system to the environment. To be able to better absorb the temperature fluctuations and the associated temperature stresses that occur during operation of the sound absorber 1 and/or the exhaust system, the outlet line 12 is mounted by at least one sliding seat 13 in the sound absorber 1. The sliding seat 13 yields one degree of freedom in the longitudinal direction of the outlet line 12, so that a relative displacement between the sound absorber 1 and the outlet line 12 is possible with no problem. It is conceivable here for the sliding seat 13 to be arranged at the input end of the sound absorber 1 according to FIG. 2 or to be arranged at the outlet end or to be arranged at both the inlet and outlet ends.

In the area of the sound absorber 1, an area of the outlet line 12 protruding into this area is designed as a gas-permeable section, e.g., with perforations, and is surrounded by an absorber material 14 which is provided between an outer sleeve 15 of the sound absorber 1 and the outlet line 12. Sound thus has the possibility of passing through the perforations into the absorber material 14 and being "swallowed" there. Glass wool or other insulation materials, for example, may be used as the absorber material 14.

Depending on the fineness of the absorber material 14, the absorber material 14 may pass through the perforations in the outlet line 12 if a vacuum prevails inside the outlet line 12. This would lead to degradation of the absorber material 14 and thus to a loss of the sound-absorbing properties. To avoid this, in particular with very fine absorber materials 14, the outlet line 12 is sheathed at least partially by a gas-permeable blowout protection 16 within the sound absorber 1. The blowout protection 16 may be, for example, a chromium steel sleeve or a mesh fabric and it prevents passage of absorber material 14 into the outlet line 12. Steel wool, for example, may be the material for the mesh fabric.

According to the invention, with a sound absorber 1 for an exhaust system having a Y-shaped feed piece 2 situated upstream from the sound absorber, the Y-shaped feed piece and the sound absorber 1 are assembled from a common bottom shell 6 and a common top shell 7.

This reduces the multitude of different parts and at the same time creates a secure and stable connection between the sound absorber 1 and the feed piece 2. In addition, subsequent joining of the sound absorber 1 and the feed piece 2, e.g., by welding or screwing is unnecessary so that production costs can be lowered. A particularly uniform mixing of the two exhaust gas substreams is achieved due to the shape of the Y-shaped feed piece 2 and the fluid guidance contours 11 arranged therein, so that a probe 10 arranged in the area of a point of intersection between the two lines 3, 4 can be exposed to oncoming flow in a controlled manner to detect parameters relevant to the exhaust gas and to permit determination of reliable measured values.

What is claimed is:

1. A sound absorber assembly for an exhaust system for an internal combustion engine comprising:

a sound absorbing member; and a Y-shaped feed piece arranged upstream from said sound absorbing member, said feed piece combining first and second exhaust gas-carrying lines and forming a single line entering the sound absorbing member, wherein said Y-shaped feed piece and said sound absorbing member are assembled from a common bottom shell and a common top shell, wherein said common bottom shell and said common top shell rest against each other along a common longitudinal plane extending across said Y-shaped feed piece and said sound absorbing member.

2. The sound absorber assembly according to claim 1, further comprising:

a probe for measuring parameters relevant to the exhaust gas, said probe arranged on said feed piece, in an area of an intersection point of said first and second exhaust gas-carrying lines.

3. The sound absorber assembly according to claim 2, wherein said probe comprises an NOX probe.

4. The sound absorber assembly according to claim 2, wherein said feed piece has at least one fluid guidance contour, thereby causing a uniform mixing of the exhaust gases flowing out of said first and second gas-exhaust carrying lines and a controlled oncoming flow toward said probe.

5. The sound absorber assembly according to claim 1, wherein said sound absorber assembly further comprises an outlet line designed as a separate part.

6. The sound absorber assembly according to claim 5, wherein said outlet line is mounted in said sound absorbing member via at least one sliding seat.

7. The sound absorber assembly according to claim 1, wherein said sound absorbing member and said feed piece are designed as sheet metal parts.

8. The sound absorber assembly according to claim 6, wherein said sliding seat is arranged at at least one of an input end and an output end of said sound absorbing member.

9. The sound absorber assembly according to claim 5, wherein said outlet line is at least partially gas-permeable within said sound absorbing member.

10. The sound absorber assembly according to claim 5, further comprising an absorber material arranged between said outlet line and said top and bottom shells of said sound absorber assembly.

11. The sound absorber assembly according to claim 5, further comprising a gas-permeable blowout protection, at least partially sheathing said outlet line within said sound absorbing member.

12. The sound absorber assembly according to claim 11, wherein said blowout protection comprises a chromium steel sleeve.

13. A sound absorber assembly for an exhaust system for an internal combustion engine comprising:

a first and a second shell;

wherein said first and second shells are assembled to form a Y-shaped feed piece and a sound absorbing member arranged generally axially, wherein said Y-shaped feed piece is upstream from said sound absorbing member and wherein said feed piece combines first and second exhaust gas-carrying lines and forms a single line entering the sound absorbing member, wherein said common bottom shell and said common top shell rest against each other along a common longitudinal plane extending across said Y-shaped feed piece and said sound absorbing member.

14. The sound absorber assembly according to claim 13, wherein Y-shaped feed piece provides an undivided output at the single line, and wherein said sound absorbing member has an input end for receiving the undivided output provided by the single line of said Y-shaped feed piece.

15. The sound absorber assembly according to claim 14, wherein said sound absorbing member has an output end downstream from the input end, whereby the exhaust gases entering from the input end of sound absorbing member flow through the output end to an opening of the exhaust system to the environment.

16. The sound absorbing assembly according to claim 1, wherein said Y-shaped feed piece has first and second inlet portions respectively, said first and second inlet portions defined about first and second longitudinal axes and having first and second openings respectively, said first and second longitudinal axes being parallel to each other, said first and second openings being perpendicular to said first and second longitudinal axes respectively.

17. The sound absorbing assembly according to claim 1, wherein said first and second longitudinal axes of said first and second inlet portions extend within said common longitudinal plane.

18. The sound absorbing assembly according to claim 1, wherein an outlet line of said sound absorbing member is defined about a third longitudinal axis extending parallel to said first and second longitudinal axes of said first and second inlet portions.

19. The sound absorbing assembly according to claim 18, wherein said first, second, and third longitudinal axes extend within said common longitudinal plane.

20. The sound absorbing assembly according to claim 18, wherein said outlet line has an outlet opening perpendicular to said third longitudinal axis.

* * * * *